US008640267B1

(12) United States Patent
Cohen

(10) Patent No.: US 8,640,267 B1
(45) Date of Patent: Feb. 4, 2014

(54) PROTECTIVE HELMET

(76) Inventor: Yochanan Cohen, New York, NY (US)

( * ) Notice: Subject to any disclaimer, the term of this patent is extended or adjusted under 35 U.S.C. 154(b) by 9 days.

(21) Appl. No.: 13/617,663

(22) Filed: Sep. 14, 2012

(51) Int. Cl.
*A42B 3/00* (2006.01)

(52) U.S. Cl.
USPC ..... 2/411

(58) Field of Classification Search
USPC ..... 2/411, 5, 6.1, 6.6, 7, 425, 9, 412, 413, 2/414, 424, 909, 422, 410
See application file for complete search history.

(56) References Cited

U.S. PATENT DOCUMENTS

| | | | | |
|---|---|---|---|---|
| 3,174,155 | A | 3/1965 | Pitman | |
| 3,186,004 | A * | 6/1965 | Carlini | 2/413 |
| 3,320,619 | A * | 5/1967 | Lastnik et al. | 2/6.6 |
| 3,577,562 | A * | 5/1971 | Holt | 2/414 |
| 3,818,508 | A | 6/1974 | Lammers | |
| 3,906,546 | A * | 9/1975 | Gooding | 2/414 |
| 4,101,983 | A * | 7/1978 | Dera et al. | 2/412 |
| 4,345,338 | A * | 8/1982 | Frieder et al. | 2/414 |
| 4,484,364 | A * | 11/1984 | Mitchell et al. | 2/413 |
| 4,599,752 | A * | 7/1986 | Mitchell | 2/425 |
| 4,845,786 | A * | 7/1989 | Chiarella | 2/412 |
| 4,937,888 | A | 7/1990 | Straus | |
| 4,972,527 | A * | 11/1990 | Wallace | 2/414 |
| 5,018,220 | A * | 5/1991 | Lane et al. | 2/5 |
| 5,204,998 | A * | 4/1993 | Liu | 2/411 |
| 5,259,071 | A * | 11/1993 | Scott et al. | 2/413 |
| 5,680,656 | A * | 10/1997 | Gath | 2/424 |
| 5,724,681 | A | 3/1998 | Sykes | |
| 5,930,840 | A * | 8/1999 | Arai | 2/411 |
| 5,956,777 | A * | 9/1999 | Popovich | 2/424 |
| 6,032,297 | A * | 3/2000 | Barthold et al. | 2/416 |
| 6,272,692 | B1 | 8/2001 | Abraham | |
| 6,389,607 | B1 * | 5/2002 | Wood | 2/425 |
| 6,421,840 | B1 * | 7/2002 | Chen et al. | 2/410 |
| 6,709,062 | B2 * | 3/2004 | Shah | 297/464 |
| 6,912,736 | B2 * | 7/2005 | Moeller et al. | 2/421 |
| 6,931,671 | B2 * | 8/2005 | Skiba | 2/425 |
| 7,062,795 | B2 * | 6/2006 | Skiba et al. | 2/410 |
| 7,328,462 | B1 | 2/2008 | Straus | |
| 7,536,731 | B1 * | 5/2009 | Feldman | 2/410 |
| 7,676,854 | B2 * | 3/2010 | Berger et al. | 2/410 |
| 7,765,621 | B2 * | 8/2010 | Lardeau | 2/414 |
| 7,765,622 | B2 * | 8/2010 | Wiles | 2/414 |
| 7,802,321 | B2 * | 9/2010 | Boyd | 2/422 |
| 7,832,023 | B2 * | 11/2010 | Crisco | 2/414 |
| 7,930,771 | B2 * | 4/2011 | Depreitere et al. | 2/411 |
| 7,987,525 | B2 * | 8/2011 | Summers et al. | 2/425 |
| 8,166,573 | B1 * | 5/2012 | Chung et al. | 2/411 |
| 8,209,784 | B2 * | 7/2012 | Nimmons et al. | 2/424 |
| 2004/0250339 | A1 * | 12/2004 | Musal | 2/410 |
| 2004/0255370 | A1 * | 12/2004 | Moeller et al. | 2/416 |
| 2005/0278834 | A1 * | 12/2005 | Lee | 2/424 |
| 2006/0059605 | A1 * | 3/2006 | Ferrara | 2/410 |
| 2006/0059606 | A1 * | 3/2006 | Ferrara | 2/412 |
| 2006/0162053 | A1 * | 7/2006 | Lee | 2/411 |
| 2006/0242752 | A1 * | 11/2006 | Talluri | 2/412 |

(Continued)

*Primary Examiner* — Alissa L Hoey
(74) *Attorney, Agent, or Firm* — Gordon & Jacobson, PC

(57) ABSTRACT

Embodiments of a protective helmet have a shell formed from a cushioning material, a cushioning spacer layer coupled to the shell and only partially covering an inner surface of the shell, a hard inner structure having an outer surface attached to the cushioning spacer layer and an inner surface, and an innermost cushioning pad layer attached to the inner surface of the hard inner structure. A flexible thin cover extending around an outer surface of said shell and with or without graphics may be provided.

20 Claims, 8 Drawing Sheets

(56) References Cited

U.S. PATENT DOCUMENTS

| | | | | |
|---|---|---|---|---|
| 2006/0277664 | A1* | 12/2006 | Akhtar et al. | 2/410 |
| 2007/0107112 | A1* | 5/2007 | Boyd | 2/410 |
| 2007/0119538 | A1 | 5/2007 | Price | |
| 2007/0130673 | A1* | 6/2007 | Wasserkrug et al. | 2/411 |
| 2007/0157370 | A1* | 7/2007 | Joubert Des Ouches | 2/410 |
| 2007/0226881 | A1* | 10/2007 | Reinhard et al. | 2/412 |
| 2008/0222782 | A1* | 9/2008 | Stokes | 2/422 |
| 2009/0222964 | A1* | 9/2009 | Wiles | 2/6.6 |
| 2011/0107503 | A1* | 5/2011 | Morgan | 2/456 |
| 2011/0179557 | A1* | 7/2011 | Rabie | 2/411 |
| 2012/0060251 | A1* | 3/2012 | Schimpf | 2/5 |
| 2012/0151663 | A1* | 6/2012 | Rumbaugh | 2/411 |
| 2012/0186002 | A1* | 7/2012 | Bhatnagar et al. | 2/412 |
| 2012/0216339 | A1* | 8/2012 | Nimmons et al. | 2/414 |
| 2012/0233745 | A1* | 9/2012 | Veazie | 2/413 |

* cited by examiner

PROTECTIVE HELMET

BACKGROUND

1. Field

The present disclosure relates to helmets. More particularly, the present disclosure relates to protective helmets having enhanced protective performance characteristics. The present disclosure has application to football helmets, ice-hockey helmets, baseball helmets, motorcycle helmets, riot helmets, and other similar helmets, although it is not limited thereto.

2. State of the Art

Head trauma resulting from sports and other activities is a common occurrence. Generally, head trauma occurs when an object impacts the head, thereby transferring energy to the head. The most common head trauma resulting from sports is a concussion, which occurs when the brain bangs inside the skull and is bruised. To reduce the incidence of concussion, it is common practice to wear a protective helmet. Protective helmets are ostensibly designed to deflect and absorb energy transmitted by impact to the helmet, thereby diminishing the risk of head and brain injury resulting from the impact.

Protective athletic helmets have been worn for almost a century, and have evolved from sewn leather, to helmets having molded plastic outer shells with suspension webbing or other head fitting structures such as foam pads, air bladders, or padded molding on their interior. Despite the evolution of the protective helmets, the reported rate of concussions has been increasing amongst student and professional athletes in many sports. While some experts have attributed this increase to better reporting and diagnosis, other experts have attributed the increase to increased forces generated as competitive athletes continue to increase in size (mass) and increase their ability to accelerate.

What has not been necessarily considered is that the increase in concussions actually may be attributable to the structure of the evolved protective helmets. In particular, the molded hard plastic helmets have not been shown to absorb energy effectively as they tend to transmit pressure waves, and in helmet to helmet contact situations may actually add to trauma. In addition, the evolved protective helmets have a considerable weight that may lead to other injuries.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

A protective helmet includes a multilayered system including a cushioning outer shell, a hard inner structure, a cushioning spacer layer between the cushioning outer shell and the hard inner structure, with the cushioning spacer layer arranged relative to the hard inner structure to redirect energy transmitted from the cushioning outer shell along a circuitous path to air and to the hard inner structure, and plurality of innermost cushioning pads coupled to the inside of the hard inner structure.

In one embodiment, the cushioning outer shell is covered by a flexible thin cover. The flexible thin cover may be a fabric, film, foil, or other cover. The flexible thin cover may be cosmetic and may provide a surface for printing graphics. The flexible thin cover may also protect the cushioning outer shell from damage.

In one embodiment, the hard inner structure is an integral structure that includes a plurality of lateral and horizontal frame members which define a plurality of spaces. One function of the hard inner structure is to provide a structural integrity for the helmet. In one embodiment, the spaces between the members are maximized in size to reduce the weight of the structure while still maintaining structural integrity.

In one embodiment, the cushioning spacer layer includes a plurality of elements glued or otherwise attached to the cushioning outer shell and to the hard inner structure. In another embodiment, the cushioning spacer layer comprises a single member defining a plurality of spaces. The cushioning spacer layer elements or member may include a plurality of layers of different densities.

In one embodiment the cushioning spacer layer member or elements at least partially overlie the spaces defined by the hard inner structure.

In one embodiment one or more of cushioning layers or elements is formed from a foam material such as an elastomeric, cellular foam material. In another embodiment, one or more of the cushioning layers is made of thermoplastic polyurethane (TPU).

DETAILED DESCRIPTION

Figure 1:
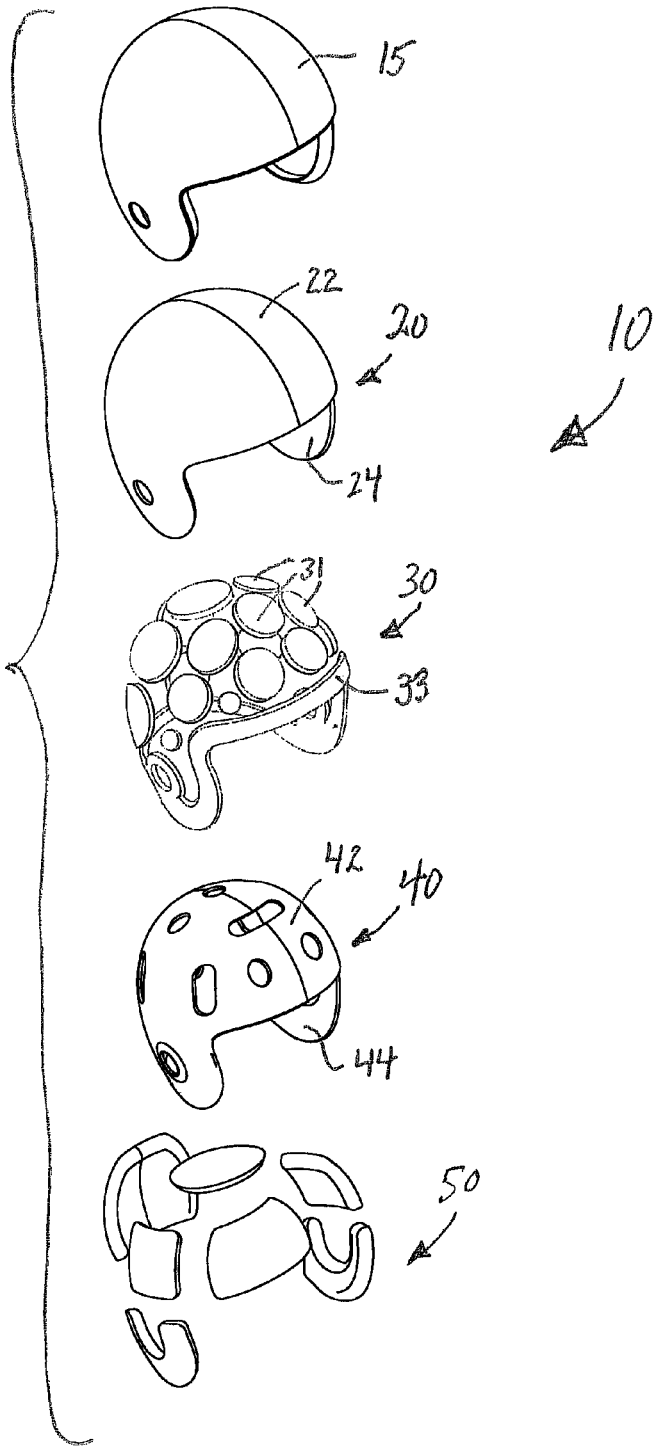
FIG. 1 is a perspective exploded view of a first embodiment of a helmet.
Figure 2:
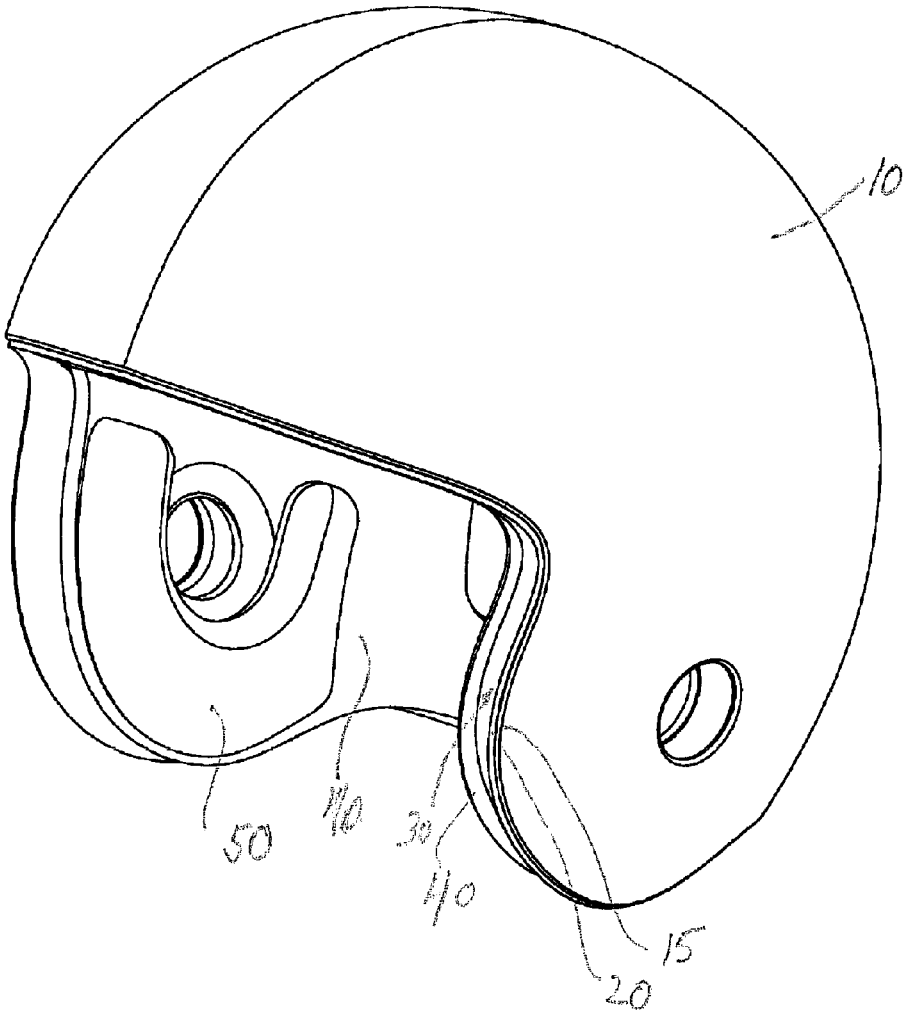
FIG. 2 is a front perspective view of the first embodiment.
Figure 3:
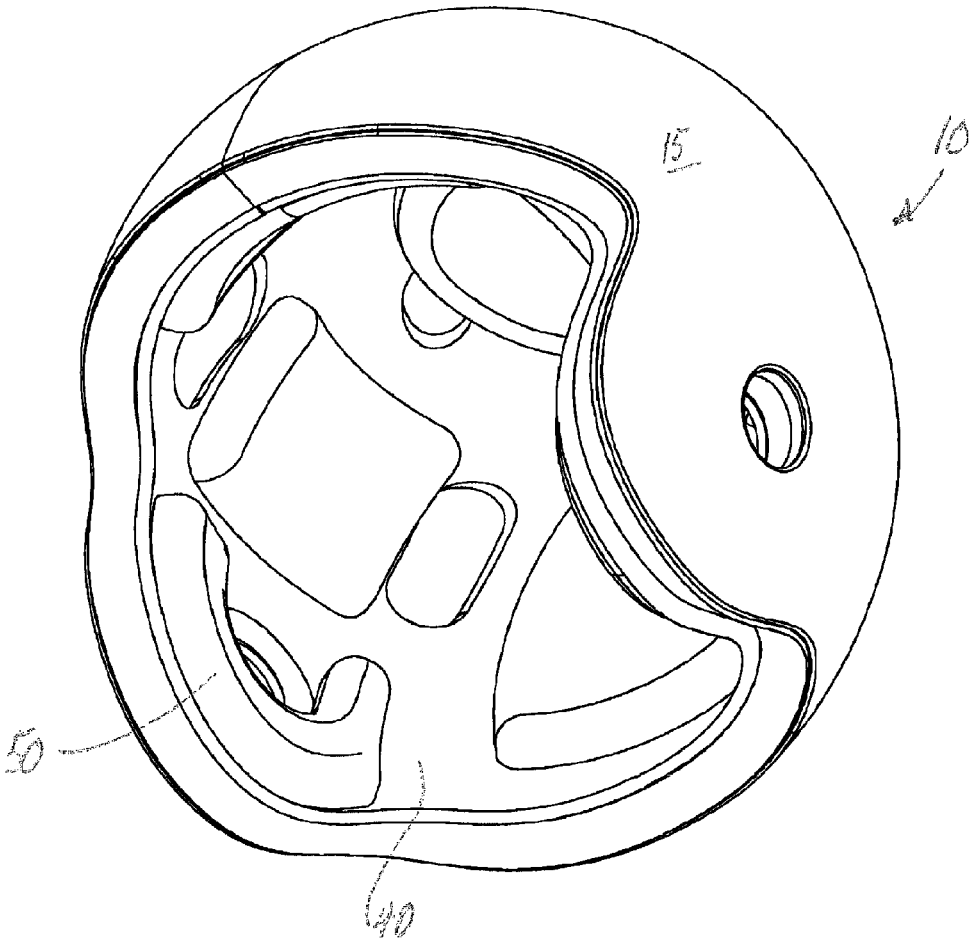
FIG. 3 is an inside perspective view of the first embodiment.
Figure 4:
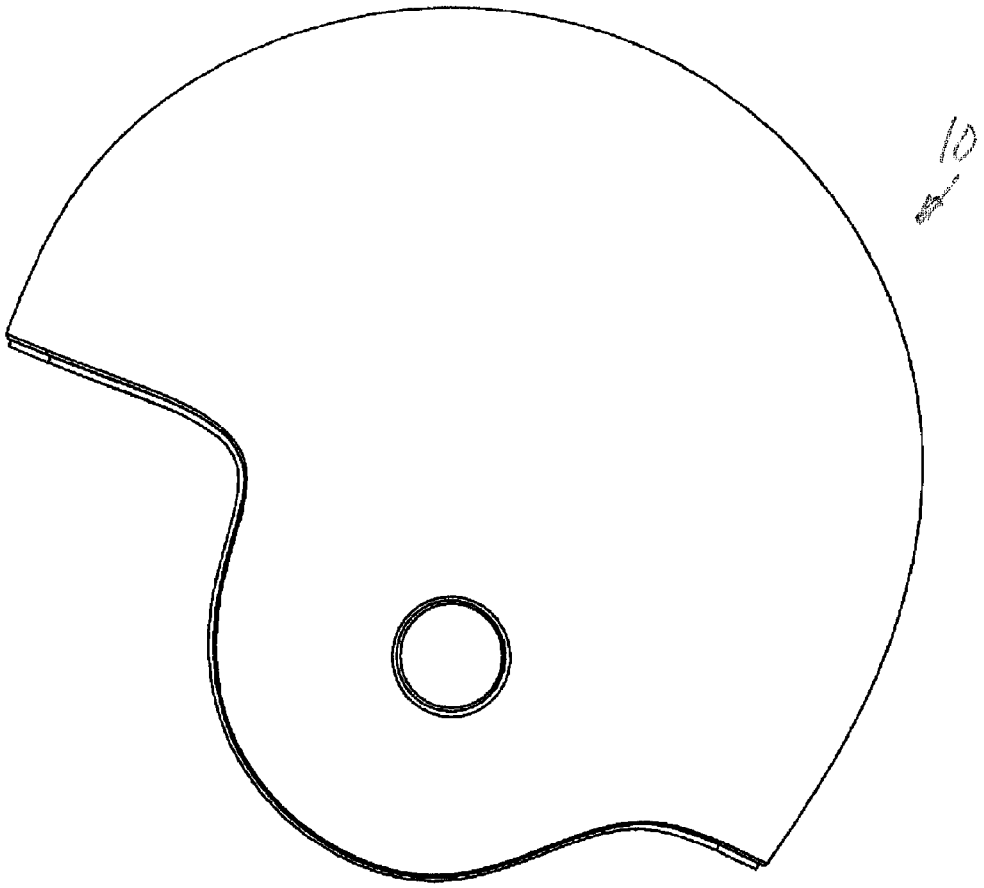
FIG. 4 is a side view of the first embodiment.

One embodiment of a protective helmet 10 is seen in FIGS. 1-5. Helmet 10 includes a multilayered system including an optional outermost cover 15, a cushioning outer shell 20 having an outer surface 22 and an inner surface 24, a hard inner structure 40 with an outer surface 42 and an inner surface 44, a cushioning spacer layer 30 located between and separating the cushioning outer shell 20 and the hard inner structure 40, and one or more innermost cushioning pads 50 coupled to the inside surface 44 of the hard inner structure 40. The innermost cushioning pads 50 may be covered by another fabric layer 60. As will be discussed in more detail hereinafter, the cushioning spacer layer 30 separates the cushioning outer shell 20 from the hard inner structure 40 and redirects energy transmitted from the cushioning outer shell along a circuitous path to air gaps and to the hard inner structure, thereby causing dissipation of pressure wave energy. Pressure wave energy that does reach the hard inner structure 40 is further dissipated by the innermost cushioning pads 50 before reaching the head of the helmet user (not shown).

With the structure of helmet 10, when the helmet is hit by a projectile, the energy imparted by the projectile to the helmet can take various paths. First, it should be appreciated that the cushioning outer shell 20 will absorb and/or distribute some or all of the energy. The energy may be absorbed by deflection of the foam cushioning. If some of the energy passes through the cushioning outer shell 20 it can either pass into the cushioning spacers 30 or into the air between the cushioning spacers. Again, if the energy pass into the cushioning spacers, the energy may be absorbed by deflection of the cushioning spacers. Alternatively or in addition, the energy may be absorbed in the air between the cushioning spacers. Energy passing through the cushioning spacer level will reach the hard inner structure 40 or air gaps therein where it can be one or more of reflected, distributed, absorbed or transmitted. Typically, the hard inner structure 40 will not absorb much energy. As a result, the function of the hard inner structure 40 is primarily one of lending structural integrity to the helmet 10. Any energy passing through the hard inner structure or the air gaps therein will be passed to the innermost cushioning pads 50 or the air gaps between the pads where the energy again may be absorbed by deflection of the cushioning pads 50 or by the air gaps therein. With all of these possible paths, it will be appreciated that the energy imparted by impact to the helmet will be significantly dissipated before reaching the head of the user. In addition, by forcing the energy through a tortuous path due to the use of cushioning and multiple layers with air gaps, the resistance to the energy shock waves by the helmet is increased. In this manner, the incidence of brain concussions of wearers of the helmet 10 can be reduced.

Figure 5:
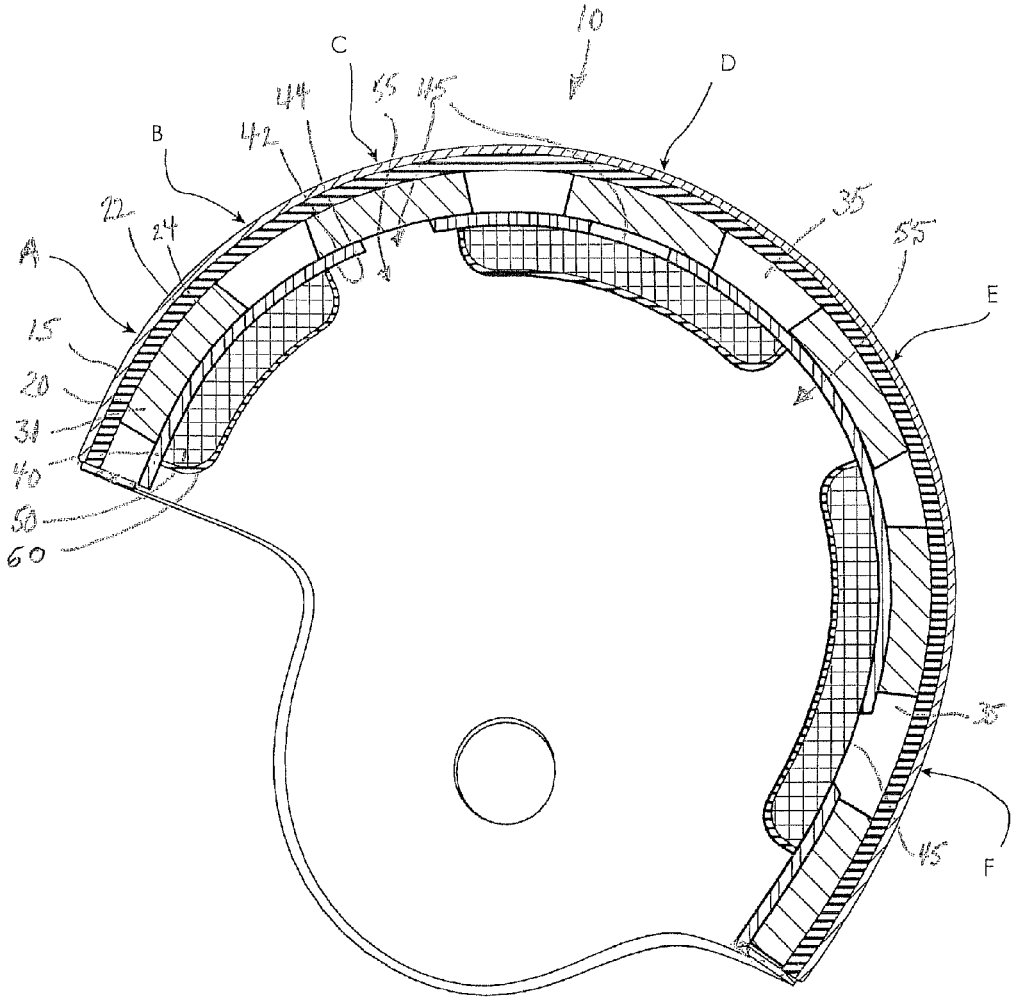
FIG. 5 is a cross-sectional view of the first embodiment.

Some of the energy paths through the helmet can be seen by reference to the FIG. 5 which shows six different cross-sectional paths through the helmet. A first cross section at location A through the helmet shows a fabric cover 15, the cushioning shell 20, a cushioning spacer pad 30, a hard inner structure 40, an inner cushioning pad 50, and an inner fabric cover 60 for the inner cushioning pad 50. Location B shows the cover 15, cushioning shell 20, space 35 (e.g., air between the cushioning spacer pads 30), the hard inner structure 40, an inner cushioning pad 50, and an inner fabric cover 60 for the inner cushioning pad 50. Location C includes cover 15, the cushioning shell 20, a cushioning pad 30, space 45 (e.g., air at gaps in the hard shell 40), and additional space 55 (e.g., air at gaps between the inner cushioning pads 50). Location D shows the cover 15, the cushioning shell 20, space 35 (e.g., air between the cushioning spacer pads 30), additional space (e.g., air at gaps in the hard shell 40), an inner cushioning pad 50, and fabric cover 60. Location E includes the cover 15, the cushioning shell 20, the cushioning spacer pad 30, the hard inner structure 40, and space 55 (e.g., air gap between the inner cushioning pads 50). Location F shows the cover 15, the cushioning shell 20, space 35 between the cushioning spacer pads 30, space 45 (air gaps in the hard shell), an inner cushioning pad 50 and fabric cover 60.

It should be appreciated that the described cross-sections give certain energy paths through the helmet 10, but that many other exist, and it is not necessary that all of these paths exist simultaneously in a helmet. In fact, it will be appreciated that energy waves will generally take a path of least resistance through a substance which may not correspond exactly to any of the cross-sections. Because harder substances will generally transmit energy waves more readily than air, the air gaps will cause the energy to travel and spread radially through the cushioning shell 20 and the hard inner structure 40. However, travel through a longer distance in the cushioning shell 20 and the hard inner structure 40 causes further attenuation of the energy.

In one embodiment, the flexible thin cover 15 may be a fabric, film, foil, or other cover. The flexible thin cover may be cosmetic and may provide a surface for printing graphics. The flexible thin cover may also protect the cushioning outer shell from damage. If desired, the flexible thin cover may extend around the periphery of the helmet (as suggested in FIG. 5 but not shown in FIGS. 2 and 3) to protect the periphery of the cushioning shell 20 and the cushioning spacer layer 30 and optionally the hard inner structure 40 and even the innermost cushioning pads 50. Alternatively, if desired, a flexible band may be used to extend around the periphery and cover the peripheral edge of cushioning shell 20, the spacer layer 30 and optionally the hard layer 40. In one embodiment, the flexible thin cover is made from ballistic nylon, a high denier nylon thread with a dense basket wave such as Cordura (a trademark of Invista, Wichita, Kans.). In another embodiment, the flexible thin cover is made from a Neoprene (a trademark of DuPont, Delaware) rubber (polychloroprene) fabric. In another embodiment, the flexible thin cover is made from a polyester fabric. In another embodiment, the flexible thin cover is made from non-woven fabric. In another embodiment, the flexible thin cover is made from a printable film. By way of example only, the thin cover may be between 0.1 mm and 10 mm thick, although it may be thinner or thicker. By way of another example, the flexible thin cover may be between 0.3 mm and 3.25 mm thick. By way of another example, the flexible thin cover may be between 1.0 mm and 1.5 mm thick. The thin cover 15 may be attached at one or more places to the cushioning shell 20, so that the cover may be removed from the shell 20 without damaging the shell. By way of example only, attachment may be made by use of Velcro (a trademark of Velcro USA Inc., Manchester, N.H.). Alternatively, the thin cover may be glued, tacked or sewn to the shell 20. In one embodiment, the thin cover 15 covers the entire cushioning shell 20.

In one embodiment the cushioning shell 20 is comprised of foam. The foam may be an elastomeric, cellular foam or any other desirable foam. In another embodiment, the cushioning shell is comprised of thermoplastic polyurethane (TPU). In another embodiment, the cushioning shell is comprised of open-cell polyurethane. In another embodiment, the cushioning shell is comprised of closed cell polyolefin foam. In another embodiment, the cushioning shell is comprised of polyethylene foam which may be a high density polyethylene foam. In one embodiment, the outer surface 22 of the cushioning shell 20 is generally (hemi-)spherical in shape. By way of example and not by way of limitation, the cushioning shell may be between 3 mm and 13 mm thick, although it may be thinner or thicker. By way of example, and not by way of limitation, the cushioning shell may have a density of between 3.4 lbs/ft$^3$ (approximately 0.016 g/cm$^3$) and 25 lbs/ft$^3$ (approximately 0.4 g/cm$^3$), although it may be more dense or less dense.

Figure 6A:
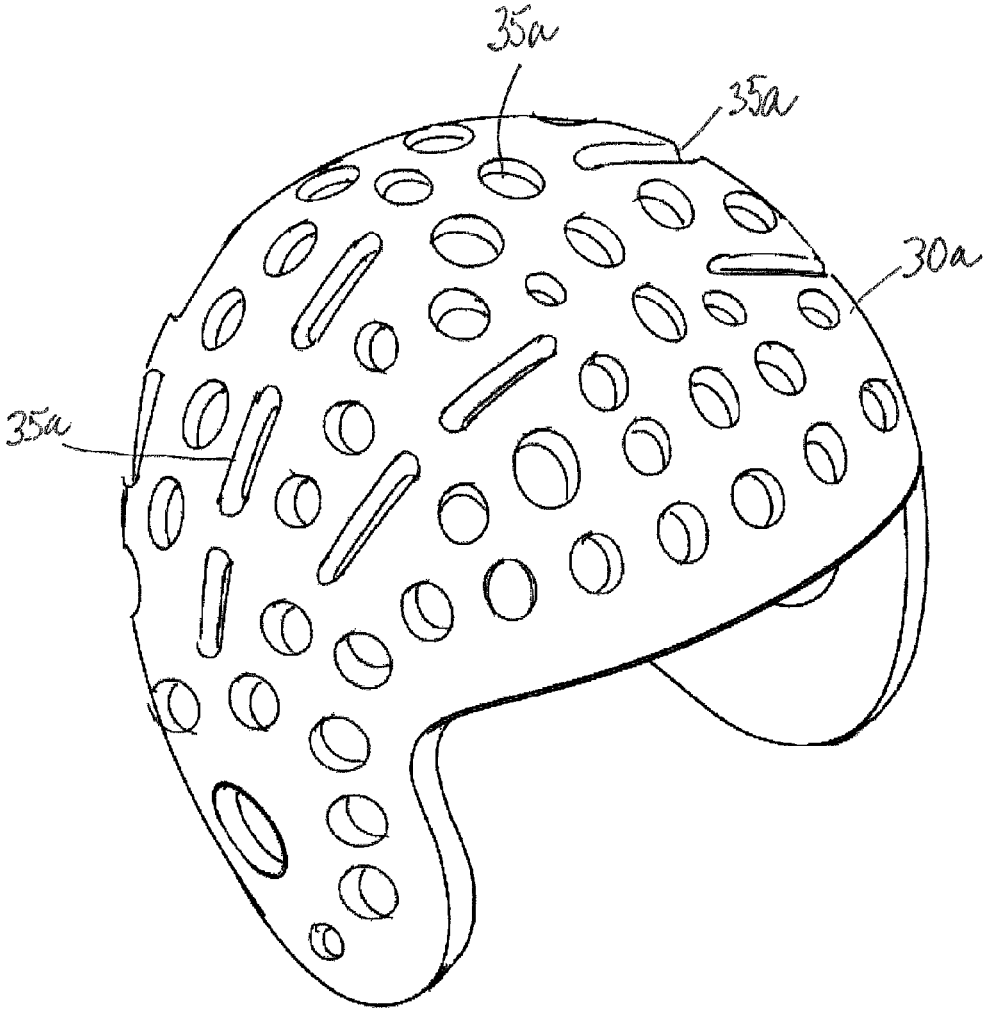
FIG. 6*a* is a perspective view of an alternative cushioning spacer layer.

In one embodiment the cushioning spacer layer 30 comprises a plurality of pads 31. The pads 31 may be circular in shape or may be formed in other shapes. Multiple shapes may be used together. In one embodiment, the spacer layer may include a strip of material 33 (seen in FIG. 1) around the peripheral edge of the helmet between the shell 20 and the hard inner structure 40 that can prevent foreign material from entering between the shell 20 and the hard inner structure 40. In another embodiment (seen in FIG. 6*a*) the cushioning spacer layer is a single pad 30*a* defining multiple cut-outs 35*a* (i.e., the equivalent of multiple connected pads). In one embodiment the spacer layer 30 is comprised of foam. The foam may be an elastomeric, cellular foam or any other desirable foam. In another embodiment, the cushioning spacer layer is comprised of thermoplastic polyurethane (TPU). In another embodiment, the cushioning spacer layer is comprised of open-cell polyurethane. In another embodiment, the cushioning spacer layer is comprised of closed cell polyolefin foam. In another embodiment, the cushioning spacer layer is comprised of polyethylene foam which may be a high density polyethylene foam. In another embodiment, the cushioning spacer layer 30 has multiple layers formed from different materials. By way of example and not by way of limitation, the cushioning spacer layer may be between 3 mm and 26 mm thick, although it may be thinner or thicker. As another example, the cushioning spacer layer may be between 6 and 13 mm thick. By way of example, and not by way of limitation, the cushioning spacer layer may have a density of between 3.4 lbs/ft$^3$ (approximately 0.016 g/cm$^3$) and lbs/ft$^3$ (approximately 0.4 g/cm$^3$), although it may be more dense or less dense.

According to one embodiment, the spacer layer 30 covers approximately fifty percent of the inner surface area of the shell 20. In another embodiment, the spacer layer covers between twenty percent and eighty percent of the inner surface area of the shell. The spacer layer 30 should cover sufficient area between the shell 20 and the hard inner structure 40 so that upon most expected impacts to the helmet 10, the shell 20 does not directly come into contact with the hard inner structure 40. Regardless of the material and arrangement of the cushioning spacer layer 30, in one embodiment the cushioning material is affixed to the shell 20 and to the hard inner structure. Affixation can be done with glue, Velcro or any other affixation means.

In one embodiment, the hard inner structure 40 is comprised of a polycarbonate shell. In another embodiment, the hard inner structure 40 is comprised of a different hard plastic such a polypropylene. In another embodiment, the hard inner structure 40 is comprised of ABS resin. In another embodiment, the hard inner structure 40 is made of carbon fiber or fiberglass. In another embodiment, the hard inner structure is made of polypropylene. In one embodiment, as shown in FIGS. 1 and 5, the hard inner structure 40 defines a plurality of cut-outs 45. In one embodiment at least one of the cut-outs 45 is at least partially covered by a cushioning spacer pad 30. In another embodiment, at least one of the cut-outs 45 is at least partially covered by an inner cushioning pad 50. As previously mentioned, in one embodiment the hard inner structure 40 is affixed to the spacer layer 30. Affixation can be done with glue, Velcro or any other affixation means. By way of example and not by way of limitation, the hard inner structure is between 1.5 mm and 6.0 mm thick, although it may be thinner or thicker. As another example, the hard inner structure 40 is between 2.5 mm and 3.1 mm thick.

In one embodiment, the one or more innermost cushioning pad(s) 50 is comprised of foam. The foam may be an elastomeric, cellular foam or any other desirable foam. In another embodiment, the cushioning pad(s) 50 is comprised of thermoplastic polyurethane (TPU). In another embodiment, the cushioning pad(s) is comprised of open-cell polyurethane. In another embodiment, the cushioning pad(s) is comprised of closed cell polyolefin foam. In another embodiment, the cushioning pad(s) is comprised of polyethylene foam which may be a high density polyethylene foam. In one embodiment the innermost cushioning pad 50 is a single pad defining multiple cut-outs (i.e., the equivalent of multiple connected pads). In another embodiment, a plurality of innermost cushioning pads 50 are provided. Regardless, the single pad with the cut-outs or the multiple pads are arranged in a desired configuration and are affixed to the hard inner structure 40. Affixation can be done with glue, Velcro or any other affixation means. By way of example and not by way of limitation, the innermost cushioning layer may be between 3 mm and 26 mm thick, although it may be thinner or thicker. By way of example, and not by way of limitation, the innermost cushioning pads may have a density of between 3.4 lbs/ft$^3$ (approximately 0.016 g/cm$^3$) and 25 lbs/ft$^3$ (approximately 0.4 g/cm$^3$), although they may be more dense or less dense.

In one embodiment, the innermost cushioning pad(s) 50 is covered by a fabric layer 60 (seen in FIG. 5). In one embodiment, fabric layer 60 is absorbent. In one embodiment fabric layer 60 is removable from the foam pad(s) 50. In one embodiment, the flexible thin cover is made from ballistic nylon, a high denier nylon thread with a dense basket wave such as Cordura (a trademark of Invista, Wichita, Kans.). In another embodiment, the flexible thin cover is made from a Neoprene (a trademark of DuPont, Delaware) rubber (polychloroprene) fabric. In another embodiment, the flexible thin cover is made from a polyester fabric. In another embodiment, the flexible thin cover is made from non-woven fabric. By way of example only, the thin cover may be between 0.3 mm and 3.25 mm thick, although it may be thinner or thicker. By way of another example, the flexible thin cover may be between 1.0 mm and 1.5 mm thick.

Figure 6B:
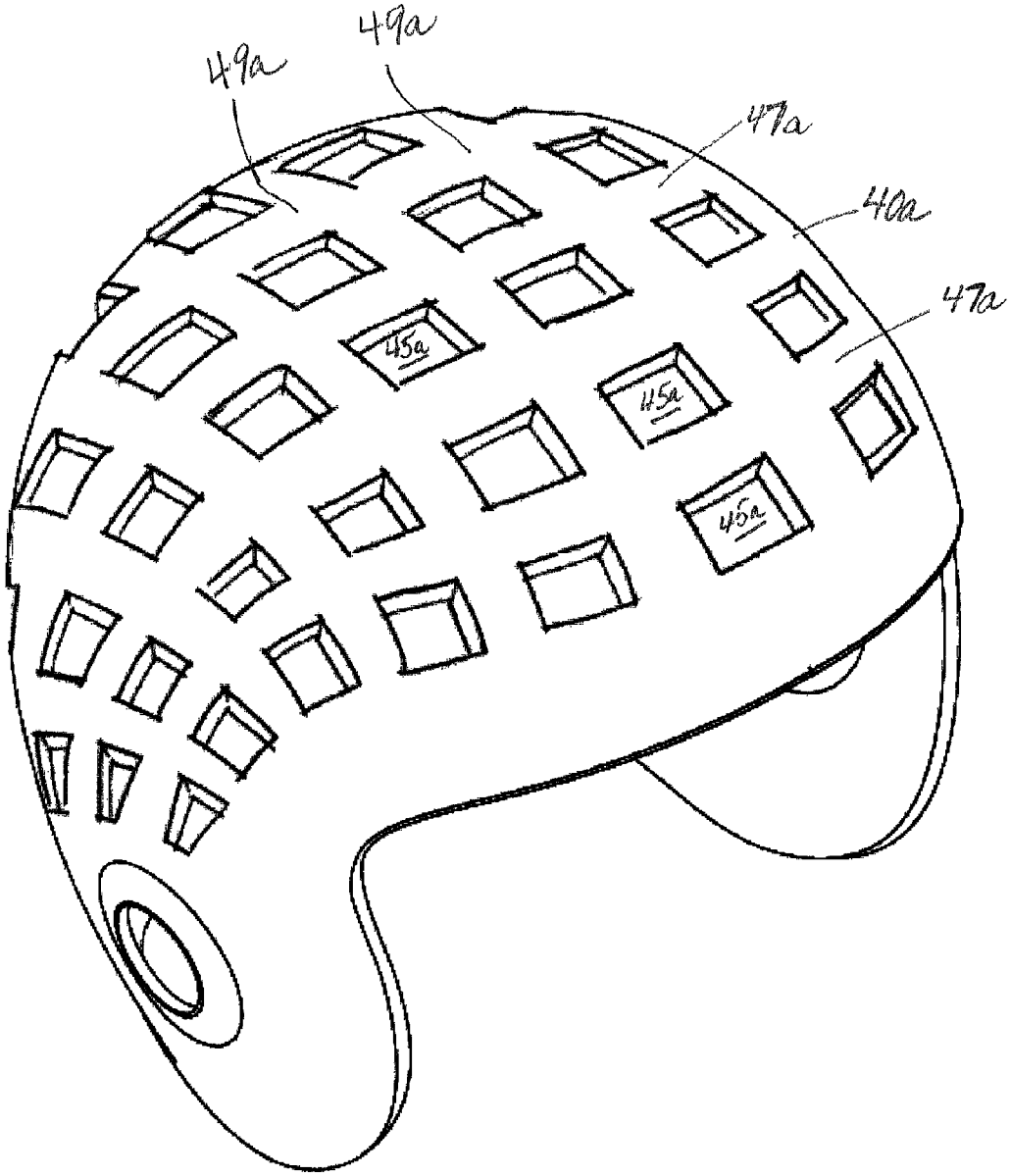
FIG. 6*b* is a perspective view of an alternative hard inner structure.

Turning to FIG. 6*b*, an alternative hard inner structure 40*a* is shown. Hard inner structure 40*a* includes a plurality of horizontal frame members 47*a* and lateral frame members 49*a* that together define spaces 45*a*. As will be appreciated, hard inner structure 40*a* effectively defines a lattice for support of the remainder of the helmet. However, by using less material, the weight of the hard inner structure and hence the helmet may be reduced. In the embodiment of FIG. 6*b*, the spaces 45*a* are roughly equal in area to one-half the area taken by the frame members 47*a* and 49*a*. In another embodiment, the spaces 45*a* are roughly equal to between one-quarter and twice the area taken by the frame members 47*a* and 49*a*.

Figure 7A:
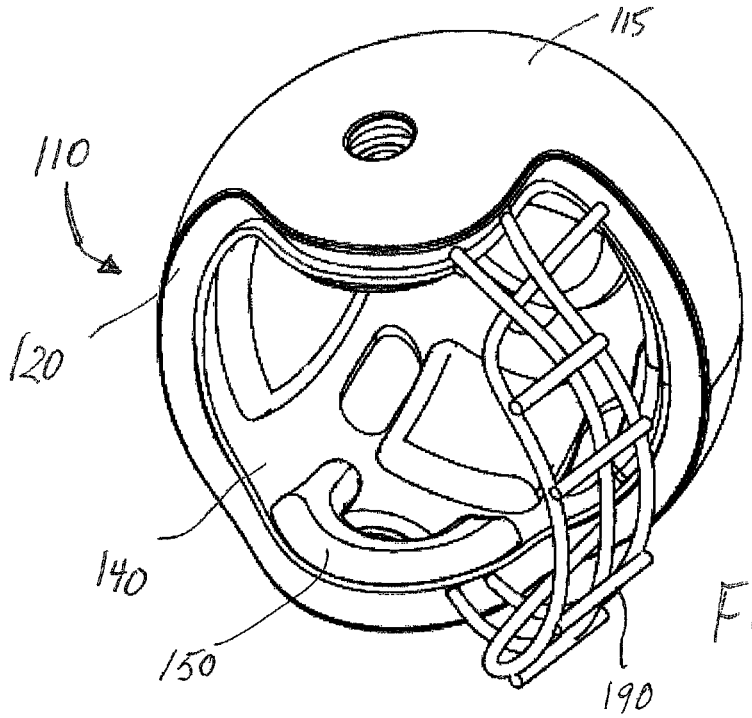
FIGS. 7*a* and 7*b* are bottom and perspective views of an embodiment of a football helmet.
Figure 7B:
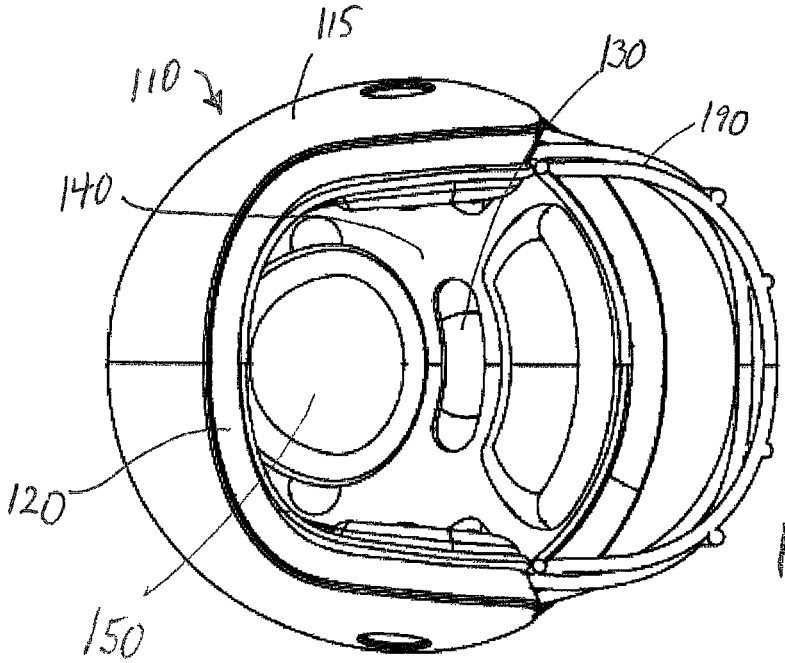

The helmets previously described may be used as or in conjunction with football helmets, ice-hockey helmets, baseball helmets, motorcycle helmets, riot helmets, and other similar helmets, although they are not limited thereto. Thus, for example, a riot helmet can have a polycarbonate face extending from the front face of the helmet. As seen in FIGS. 7*a* and 7*b*, a football helmet 110 is provided with the layered structure described above with reference to FIGS. 1-5 (outermost cover 115, a cushioning outer shell 120, a hard inner structure 140, a cushioning spacer layer 130 located between and separating the cushioning outer shell 120 and the hard inner structure 140, and one or more innermost cushioning pads 150 coupled to the inside surface of the hard inner structure 140) in conjunction with a face guard 190. In one embodiment, the face guard 190 is of the type that can break away from the remainder of the helmet 110 when subjected to excessive twisting forces.

In one embodiment, the football helmet 110 has a thickness of between 20 mm and 50 mm, although it may be thinner or thicker.

There have been described and illustrated herein several embodiments of a helmet. While particular embodiments have been described, it is not intended that the claims be limited thereto, as it is intended that the claims be as broad in scope as the art will allow and that the specification be read likewise. Thus, while particular materials for cushioning layers have been disclosed, it will be appreciated that other materials may be used as well. Similarly, while particular types of materials have been disclosed for the hard structural layer, it will be understood that other materials can be used. Also, while particular types of materials for the cover layers have been described, other materials can be used. In addition, while the shell was shown as being continuous, it will be appreciated that small holes may be drilled in the shell structure for ventilation purposes and for attaching straps or other structures. For purposes of the claims, such a shell should still be considered "continuous". It will therefore be appreciated by those skilled in the art that yet other modifications could be made without deviating from the spirit and scope of the claims.

What is claimed is:

1. A protective helmet comprising:

a continuous protective cushioning shell layer formed from a cushioning foam material and having an inner surface, said continuous protective cushioning shell layer being an outermost or next-to-outermost layer of the protective helmet;

a cushioning spacer layer coupled to said inner surface of said continuous protective cushioning shell layer, said cushioning spacer layer including a cushioning structure that only partially covers said inner surface of said shell and defining gaps in or between the cushioning structure, wherein at least one of said cushioning structure and said gaps is non-uniform in at least one of size and shape;

a hard inner structure having an outer surface and an inner surface, said outer surface attached to said cushioning spacer layer, said hard inner structure being harder than said continuous protective cushioning shell layer and said cushioning spacer layer; and an innermost cushioning pad layer attached to said inner surface of said hard inner structure, wherein impact energy applied to said continuous shell is forced through a tortuous path in said cushioning spacer layer.

2. A protective helmet according to claim 1, further comprising:

a flexible thin cover extending around an outer surface of said continuous protective cushioning shell layer and constituting an outermost layer of said protective helmet, wherein said continuous protective cushioning shell layer is a next-to-outermost layer of the protective helmet.

3. A protective helmet according to claim 2, wherein:

said cushioning foam material is at least one of thermoplastic polyurethane and open-cell polyurethane.

4. A protective helmet according to claim 2, wherein:

said cushioning spacer layer is formed from at least one of foam, thermoplastic polyurethane, and open-cell polyurethane.

5. A protective helmet according to claim 4, wherein:

said cushioning spacer layer comprises at least one spacer defining spaces.

6. A protective helmet according to claim 5, wherein:

said at least one spacer comprises a plurality of spacers.

7. A protective helmet according to claim 2, wherein:

said innermost cushioning pad layer is formed from at least one of foam, thermoplastic polyurethane, and open-cell polyurethane.

8. A protective helmet according to claim 7, wherein:

said innermost cushioning pad layer comprises at least one pad defining spaces.

9. A protective helmet according to claim 8, wherein:

said innermost cushioning pad layer comprises a plurality of pads defining space therebetween.

10. A protective helmet according to claim 8, further comprising:

at least one cover covering said at least one pad defining spaces.

11. A protective helmet according to claim 2, wherein:

said hard inner structure is formed from at least one polycarbonate, hard plastic, ABS resin, polypropylene, carbon fiber and fiberglass.

12. A protective helmet according to claim 11, wherein:

said hard inner structure defines a plurality of cut-outs.

13. A protective helmet according to claim 11, wherein:

said hard inner structure includes a plurality of horizontal frame members and a plurality of lateral frame members that define spaces.

14. A protective helmet according to claim 13, wherein:

a cumulative surface area of said spaces is between one-third and twice a surface area of a cumulative surface area defined by inner surfaces of said horizontal and lateral frame members.

15. A protective helmet according to claim 2, wherein:

said flexible thin cover comprises one of a fabric, film and foil.

16. A protective helmet according to claim 15, wherein:

said fabric comprises one of ballistic nylon, polychloroprene, and polyester fabric.

17. A protective helmet according to claim 2, wherein:

said flexible thin cover is adapted to be removable from said protective cushioning shell layer without damaging said protective cushioning shell layer.

18. A protective helmet, comprising:

an outermost flexible thin cover;

a continuous protective cushioning shell layer formed from a cushioning foam material, said continuous shell having an outer surface and an inner surface, said outer surface adjacent to and covered by said outermost flexible thin cover and constituting a next-to-outermost layer;

a cushioning spacer layer coupled to and only partially covering said inner surface of said shell, said cushioning spacer layer including at least one pad with a cushioning structure defining first spaces and formed from at least one of foam and thermoplastic polyurethane wherein at least one of said cushioning structure and said first spaces is non-uniform in size or shape;

a hard inner structure having an outer surface and an inner surface and defining second spaces, said outer surface of said hard inner structure attached to and inside said cushioning spacer layer, said hard inner structure being harder than said cushioning foam material of said continuous protective cushioning shell layer; and an innermost cushioning pad layer attached to said inner surface of said hard inner structure and formed from at least one of foam, thermoplastic polyurethane, and open-cell polyurethane, wherein impact energy applied to said continuous shell is forced through a tortuous path in said cushioning spacer layer.

19. A protective helmet according to claim 18, wherein:

said hard inner structure is formed from at least one polycarbonate, hard plastic, ABS resin, polypropylene, carbon fiber and fiberglass, and said innermost cushioning pad layer comprises a plurality of innermost pads defining third spaces.

20. A protective helmet, consisting essentially of:

an outermost flexible thin cover;

a continuous protective cushioning shell layer formed from a cushioning foam material, said continuous shell having an outer surface and an inner surface, said outer surface adjacent to and covered by said outermost flexible thin cover and constituting a next-to-outermost layer;

a cushioning spacer layer coupled to and only partially covering said inner surface of said shell, said cushioning spacer layer including at least one pad with a cushioning structure defining first spaces and formed from at least one of foam and thermoplastic polyurethane wherein at least one of said cushioning structure and said first spaces is non-uniform in size or shape;

a hard inner structure having an outer surface and an inner surface and defining second spaces, said outer surface of said hard inner structure attached to and inside said cushioning spacer layer, said hard inner structure being harder than said cushioning foam material of said continuous protective cushioning shell layer;

an innermost cushioning pad layer attached to said inner surface of said hard inner structure and formed from at least one of foam, thermoplastic polyurethane, and open-cell polyurethane, wherein impact energy applied to said continuous shell is forced through a tortuous path in said cushioning spacer layer; and a faceguard coupled to said hard inner structure.

* * * * *